US007603059B2

(12) United States Patent
Marumoto

(10) Patent No.: US 7,603,059 B2
(45) Date of Patent: Oct. 13, 2009

(54) SHAFT COUPLING, AND FUNCTION UNIT DRIVE DEVICE FOR AN IMAGE FORMING DEVICE COMPRISING THE SAME

(75) Inventor: Takeshi Marumoto, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 773 days.

(21) Appl. No.: 11/275,727

(22) Filed: Jan. 26, 2006

(65) Prior Publication Data

US 2006/0164500 A1 Jul. 27, 2006

(30) Foreign Application Priority Data

Jan. 26, 2005 (JP) ..... 2005-018003

(51) Int. Cl.
*G03G 15/02* (2006.01)

(52) U.S. Cl. ..... 399/167; 403/348; 403/349; 403/350; 403/351; 403/352; 403/353; 192/69.7; 192/56.61; 464/38; 464/39

(58) Field of Classification Search ..... 399/167; 403/348–353; 192/69.7, 56.61; 464/38–39
See application file for complete search history.

(56) References Cited

U.S. PATENT DOCUMENTS

2002/0110388 A1* 8/2002 Yokomori et al. ..... 399/167
2005/0025523 A1* 2/2005 Iwasaki et al. ..... 399/167
2005/0219761 A1* 10/2005 Abe ..... 360/265
2007/0048015 A1* 3/2007 Portig ..... 399/167

FOREIGN PATENT DOCUMENTS

DE 3425973 C1 11/1985
JP 2001/200858 A 7/2001

* cited by examiner

*Primary Examiner*—David M Gray
*Assistant Examiner*—Ryan D Walsh
(74) *Attorney, Agent, or Firm*—Global IP Counselors, LLP

(57) ABSTRACT

Inner circumference projections of a driven coupling are engaged with inner circumference recesses of a drive coupling. Outer circumference projections of the driven coupling are engaged with outer circumference recesses of the drive coupling. A chamfered portion formed at each tip of the rotational leading-side side surface of the inner circumference projections is capable of contact with the leading-side side surface of each inner circumference recess. A rotational trailing-side circumferential end face of each outer circumference projection and a rotational trailing-side circumferential end face of each outer circumference recess are in surface-to-surface contact with each other. As a result, the drive coupling and the driven coupling can rotate integrally without rattling in the rotational direction.

6 Claims, 18 Drawing Sheets

SHAFT COUPLING, AND FUNCTION UNIT DRIVE DEVICE FOR AN IMAGE FORMING DEVICE COMPRISING THE SAME

BACKGROUND OF THE INVENTION

1. Field of the Invention

The present invention is related to a shaft coupling, particularly to a shaft coupling for transmitting the drive from a drive shaft to a driven shaft, both the shafts being split coaxially. Furthermore, the present invention is related to a device for driving a function unit of an image forming device, particularly to a device for driving a function unit of an image forming device such as a copying machine, a printer, a facsimile, and a multifunction device that uses the shaft coupling to transmit the drive of a motor to a driven device such as a photoconductor.

2. Background Information

Conventionally, in an image forming device such as a copying machine employing an electrostatic copying system, an image forming unit transfers a toner image to a recording medium, and the recording medium to which the toner image is transferred is sent along a conveyance path to a fixing unit. In the fixing unit, the toner image is fixed to the recording medium, and then the recording medium to which the toner image is fixed is discharged to a copy receiving tray.

Recently, the image forming unit of the above image forming device includes a photoconductor unit. The photoconductor unit includes a photoconductor having a surface on which an electrostatic latent image is formed, and a developing device for supplying the photoconductor with the toner to develop the electrostatic latent image on the surface of the photoconductor into a visible toner image. The photoconductor unit is detachably attached to a main body of the image forming unit, so that it is easy to replace the photoconductor units and to perform a jam-clearing process near the image forming unit when a paper jam occurs.

In some image forming devices, a shaft coupling is provided in order to connect a revolving shaft (driven shaft) of the photoconductor and a drive shaft of the motor located in the image forming unit main body. In this device, when the photoconductor unit is to be attached to a predetermined position in the image forming unit main body, a front cover of the image forming unit main body is opened, the photoconductor unit is slid from the front side to the rear side of the image forming unit main body, and the revolving shaft of the photoconductor is connected to the drive shaft of the motor in the image forming unit main body via the shaft coupling.

FIG. 18 shows a shaft coupling 100 used in the conventional image forming device. In FIG. 18, the shaft coupling 100 consists of a drive male coupling 102 attached to a drive shaft 101, a female coupling 103 spline-engaged with the drive male coupling 102, and a driven male coupling 105 fixed to a driven shaft 104 which is coaxial with and slidable relative to the drive shaft 101, the driven male coupling 105 capable of being engaged with or disengaged from the female coupling 103. The shaft coupling 100 shown in FIG. 18 connects the driven shaft 104 (a revolving shaft as a power transmission shaft) of the driven device (for example, a photoconductive drum, a developing device, and the like) with the drive shaft 101 at the motor side such that both the shafts rotate integrally (refer to Japanese Patent Application Publication 2001-200858).

However, in the conventional shaft coupling 100 as shown in FIG. 18, the engagement portion between the female coupling 103 and the drive male coupling 102, and the engagement portion between the female coupling 103 and the driven male coupling 105, are spline engagements. Therefore, the axial length thereof will lengthen, and the size of the entire structure will become enlarged, thus making it difficult to use the shaft coupling 100 in a machine or device which must be as small as possible, such as an image forming device.

In order to solve the above-mentioned problem, a structure may be proposed as shown in FIG. 17. A shaft coupling 59 shown in FIG. 17 includes a drive coupling 62 and a driven coupling 60, the drive coupling 62 being formed with a concave portion 63 (inner circumference recess) on a face opposing to a driven coupling 60 and the driven coupling 60 being formed with a convex portion 61 (inner circumference projection) on a face opposing to the drive coupling 62. The drive coupling 62 and the driven coupling 60 are urged against each other by means of the urging force of a spring (not shown in the drawings), so that the convex portion 61 of the driven coupling 60 is engaged with the concave portion 63 of the drive coupling 62. As a result, the short sliding travel of the driven coupling 60 enables the concave portion 63 of the drive coupling 62 and the convex portion 61 of the driven coupling 60 to be engaged with each other and to be disengaged from each other.

In the shaft coupling 59 shown in FIG. 17, it is necessary to keep a circumferential clearance (wc) at the engagement portion between the concave portion 63 and the convex portion 61 in order for the concave portion 63 of the drive coupling 62 and the convex portion 61 of the driven coupling 60 to be smoothly engaged with each other. Therefore, if the torque of the driven device is large and the fluctuation of the torque is large, the concave portion 63 and a tip of the convex portion 61 may slide against each other and thereby cause wear. In addition, if the center axes of the drive shaft and the driven shaft are slightly misaligned, the wear on the concave portion 63 and the convex portion 61 may become extreme, due to a small amount of sliding at the convex-concave engagement between the drive coupling 62 and the driven coupling 60 which generates a phenomenon known as "coupling skip". "Coupling skip" is a phenomenon in which the driven coupling 60 compresses the spring to slide away from the drive coupling 62 with a small distance in order to disengage the convex portion 61 from the concave portion 63, and after the drive coupling 62 and the driven coupling 60 slip relative to each other, the concave portion 63 and the convex portion 61 are engaged again with each other by the urging force of the spring, thereby causing the engagement position of the concave portion 63 and the convex portion 61 to shift in the circumferential direction.

In view of the above, there exists a need for a shaft coupling and an image forming device having the same which overcomes the above mentioned problems in the prior art. This invention addresses this need in the prior art as well as other needs, which will become apparent to those skilled in the art from this disclosure.

SUMMARY OF THE INVENTION

In a first aspect of the present invention, a shaft coupling connects a drive shaft with a driven shaft arranged coaxially with the drive shaft. The shaft coupling comprises a first coupling attached to one of the drive shaft and the driven shaft, a second coupling attached to the other of the drive shaft and the driven shaft, the second coupling being able to move close to or move away from the first coupling, and an urging member for urging at least one of the first coupling and the second coupling to the other. The first coupling includes a first coupling portion. The first coupling portion has a first end face which is formed on a side opposing to the second coupling and extends in the axial direction, and a first concave portion which is formed on a side surface opposing to the second coupling. The second coupling includes a second coupling portion. The second coupling portion has a second end face which extends in the axial direction and can get into surface-to-surface contact with the first end face of the first coupling portion, and a first convex portion which extends toward the first coupling to be inserted into the first concave portion. The first concave portion of the first coupling portion further includes a cam face with which at least a tip of the first convex portion can get into contact for converting pressure force of the first convex portion into pressure force between the first end face and the second end face.

In a second aspect of the present invention, the first concave portion is formed with a circumferential end face on a trailing side in the rotational direction and a circumferential end face on a leading side in the rotational direction. The circumferential end face on the trailing side extends in the axial direction, and the circumferential end face on the leading side has a portion with which at least a tip of the first convex portion gets into contact. The circumferential end face on the leading side is inclined with respect to the circumferential end face on the trailing side. The cam face is the inclined surface formed on the circumferential end face on the leading side in the rotational direction of the first concave portion.

In a third aspect of the present invention, the first coupling portion is formed with a second concave portion on a surface on which the first concave portion is formed, the second concave portion encompassing the first concave portion and being formed over a range broader than an angular range of the first concave portion. The second coupling portion includes a second convex portion projecting radially outward from a main body of the second coupling and being engageable with the second concave portion. A clearance is maintained between a surface of the second concave portion facing the second coupling and a surface of the second convex portion facing the first coupling when the first convex portion is in contact with the inclined surface.

In a fourth aspect of the present invention, the first convex portion is formed with a circumferential end face on the trailing side in the rotational direction, the circumferential end face on the trailing side extending in the axial direction. A clearance is maintained between the circumferential end face on the trailing side and the circumferential end face on the trailing side of the first concave portion when the first convex portion is in contact with the inclined surface.

In a fifth aspect of the present invention, the device comprises a motor, a drive shaft connected to the motor, a driven shaft connected to the function unit and located coaxially with the drive shaft, and a shaft coupling for connecting the drive shaft with the driven shaft to transmit the drive therebetween. The shaft coupling includes a first coupling attached to one of the drive shaft and the driven shaft, a second coupling attached to the other of the drive shaft and the driven shaft, the second coupling being able to move close to or move away from the first coupling relatively, and an urging member for urging at least one of the first coupling and the second coupling to the other. The first coupling includes a first coupling portion. The first coupling portion has a first end face which is formed on a side opposing to the second coupling and extends in the axial direction, and a first concave portion which is formed on a side surface opposing to the second coupling. The second coupling includes a second coupling portion. The second coupling portion has a second end face which extends in the axial direction and can get into surface-to-surface contact with the first end face of the first coupling portion, and a first convex portion which extends toward the first coupling to be inserted into the first concave portion. The first concave portion of the first coupling portion further includes a cam face with which at least a tip of the first convex portion can get into contact for converting pressure force of the first convex portion into pressure force between the first end face and the second end face.

In a sixth aspect of the present invention, the function unit is a photoconductor unit detachably attached to a main body of the image forming unit. The photoconductor unit including a photoconductive drum which is rotated by the motor.

In the shaft coupling and the device for driving a function unit of the image forming device according to the present invention, a drive coupling and a driven coupling are unlikely to wear due to rattling at the connected portion, thus suppressing coupling skip. As a result, according to the shaft coupling of the present invention, the drive is reliably transmitted from the drive shaft to the driven shaft.

Furthermore, in the shaft coupling according to the present invention, since the drive coupling and the driven coupling are engaged with each other in concave-convex engagement, the whole structure is made more compact.

Furthermore, since the device for driving a function unit of the image forming device uses the shaft coupling according to the present invention, the drive is reliably transmitted from the motor, thereby making it possible to print a high quality image.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Schematic Structure of the Image Forming Device

Figure 1:
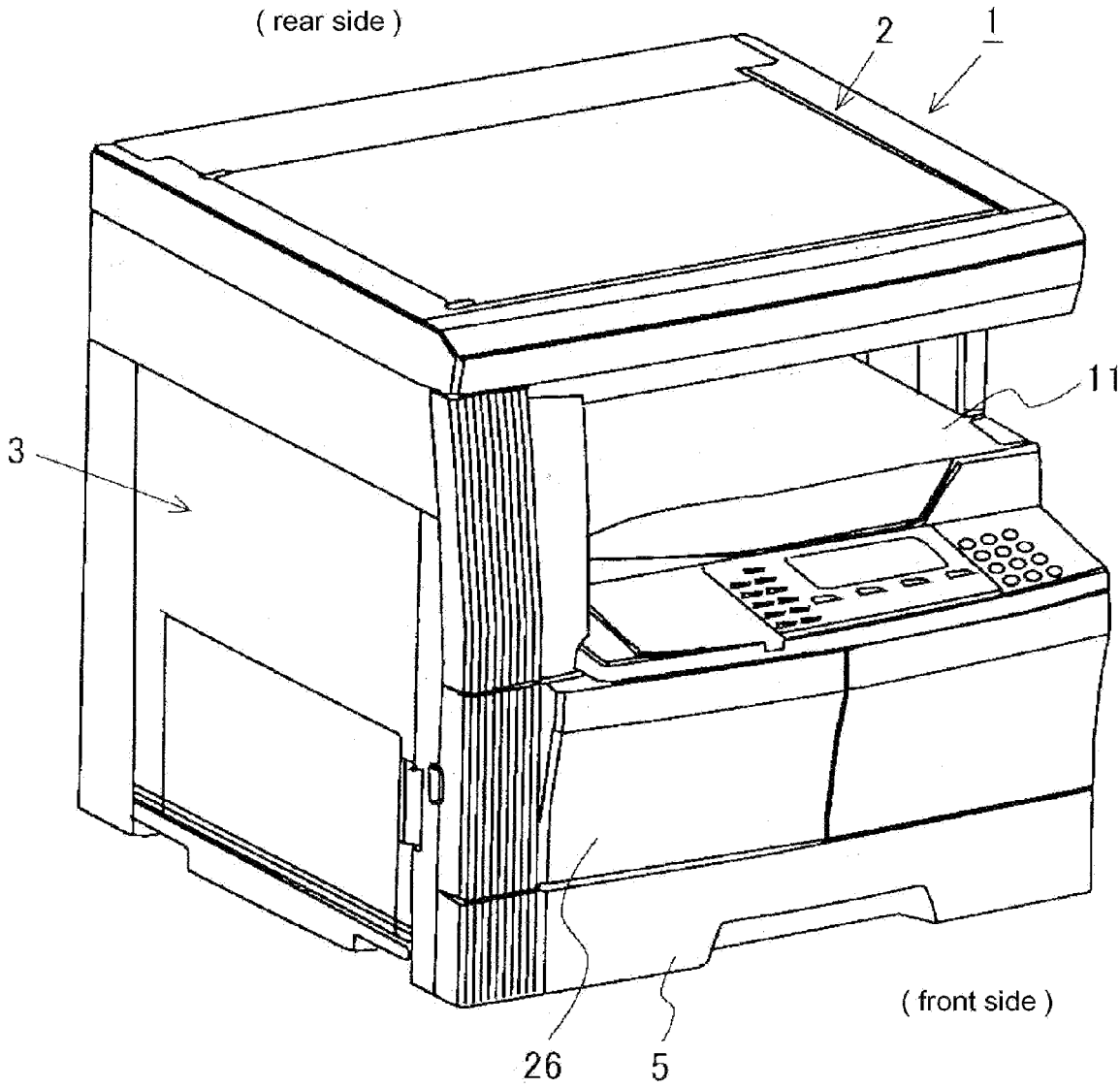
FIG. 1 is an external perspective view of an image forming device having a shaft coupling according to the present invention.
Figure 2:
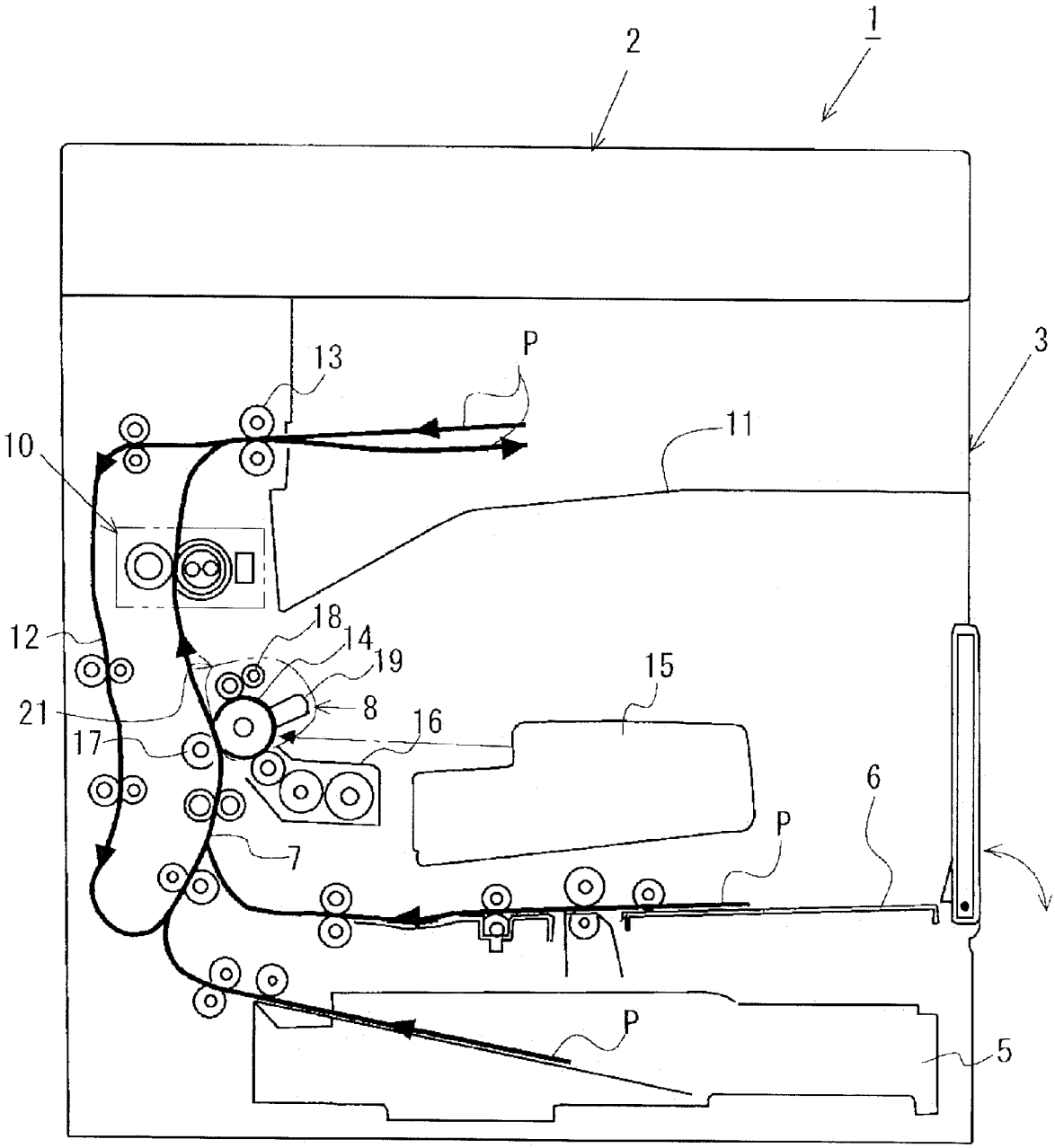
FIG. 2 is a schematic view showing the structure of the image forming device in FIG. 1.

FIG. 1 and FIG. 2 show a copying machine 1 as an image forming device according to the present invention. FIG. 1 is an external, perspective view of the copying machine 1. FIG. 2 is a view showing the schematic structure of the copying machine 1. As shown in these figures, the copying machine 1 includes a scanner unit 2 for reading an image from an original document, and a printer unit 3 for printing the image data read by the scanner unit 2 onto a recording medium P (such as a sheet of copy paper or plastic film). The printer unit 3 performs the following processes. First, a recording medium P, fed from a paper feed cassette 5 or a manual paper feed tray 6, is conveyed along a conveyance path 7, and then a toner image is transferred by an image forming unit 8 to the recording medium P. Next, the record medium P to which the toner image is transferred is forwarded to a fixing unit 10 in order to fix the toner image onto the recording medium P by means of the fixing unit 10. Finally, the recording medium P is discharged onto a copy receiving tray 11 after toner fixation. Alternatively, the recording medium P is forwarded to a duplex printing conveyance path 12 after toner fixation in order to print both sides of the recording medium P.

The duplex printing process in the copying machine 1 is as follows. The recording medium P that is discharged from the fixing unit 10 will not be completely discharged onto the copy receiving tray 11, but instead discharge rollers 13 will be reversed while the trailing end of the recording medium P is pinched by the discharge rollers 13 in order to send the recording medium P to the duplex printing conveyance path 12. The recording medium P, now upside down, is sent again through the conveyance path 7 upstream of the image forming unit 8 in the recording medium conveyance direction. Then, a toner image is transferred to the non-printed surface of the recording medium P in the image forming unit 8, and fixed again in the fixing unit 10. After the fixation, the recording medium P is discharged to the copy receiving tray 11. Alternatively, the recording medium P can be sent back again to the duplex printing conveyance path 12, turned upside down again, and simply passed through the image forming unit 8 and the fixing unit 10 and discharged onto the copy receiving tray 11.

The copying machine 1 shown in FIG. 1 and FIG. 2 functions both as a printer and a facsimile machine. It can transmit and receive data to and from various data transmit/receive devices such as copying machines, facsimile machines, and personal computers that are connected by various communication systems. Moreover, the copying machine 1 can print data received from various data transmit/receive devices or display images according to the data received on the display panel.

Photoconductor Unit

In the image forming unit 8 shown in FIG. 2, the surface of a photoconductive drum 14 as a driven device is evenly charged by a charge unit 19. A laser unit 15 irradiates the surface of the photoconductive drum 14 with a laser light to form an electrostatic latent image on the surface of the photoconductive drum 14. Then, a developing unit 16 supplies the surface of the photoconductive drum 14 with toner to develop the electrostatic latent image formed on the surface of the photoconductive drum 14 into a visible toner image. The toner image on the photoconductive drum 14 is transferred by a transfer unit 17 to a recording medium P (such as a sheet of copy paper or plastic film). Meanwhile, the residual toner on the photoconductive drum 14 is removed by a cleaning unit 18 after each image transfer.

Figure 3:
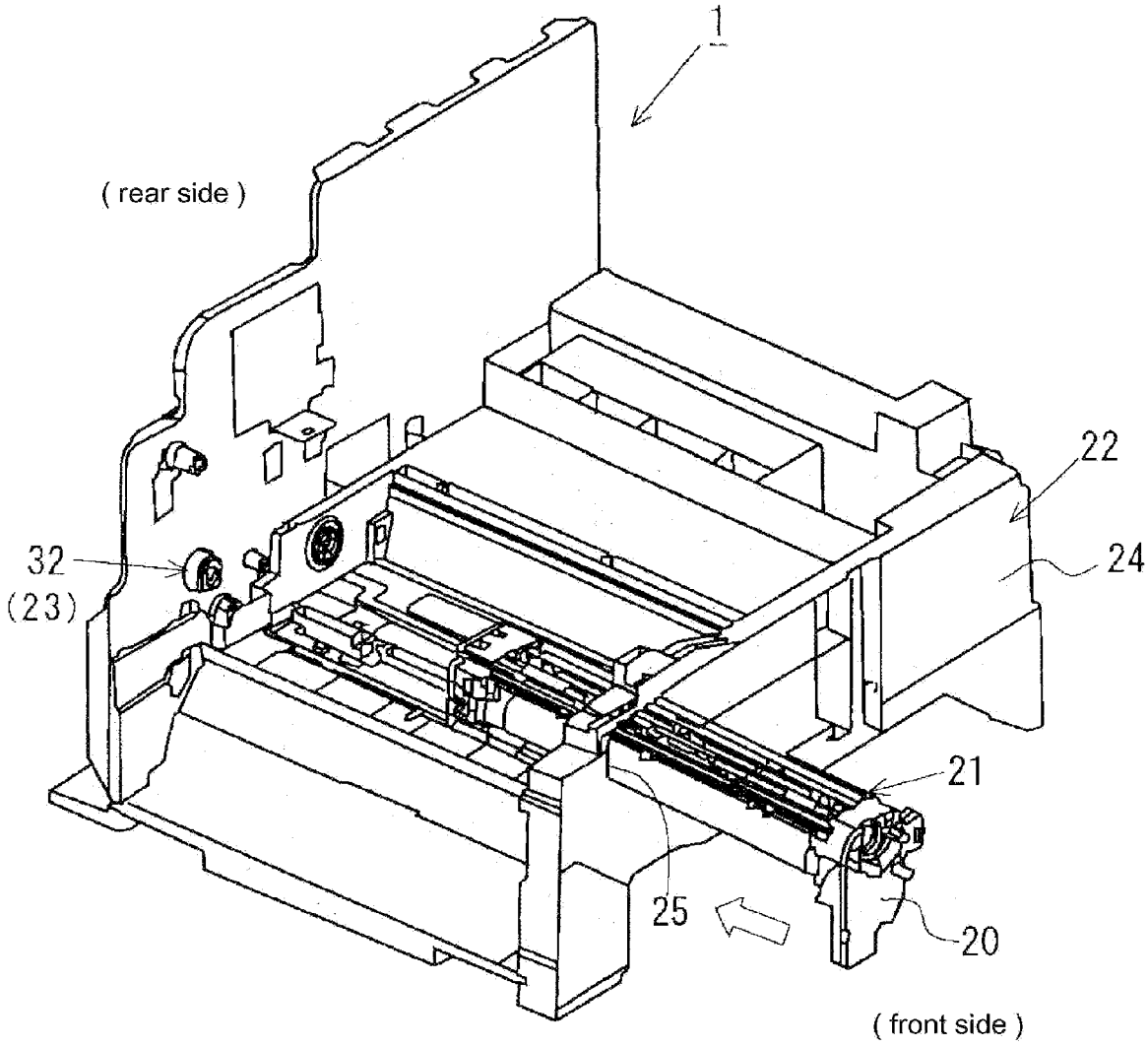
FIG. 3 is a front perspective view showing the installation of the photoconductor unit into the main body of the image forming device in a predetermined position, wherein only the main frame of the main body of the image forming device, the photoconductor unit, and the drive unit operably connected to the photoconductor unit are shown.

The synthetic resin casing 20 (refer to FIG. 3, for example) integrates the photoconductive drum 14, the charge unit 19, and the cleaning unit 18 in the image forming unit 8 to form the photoconductor unit 21, which is detachably attached to the main body 22 of the image forming device (shown in FIG. 2 and FIG. 3).

Figure 4:
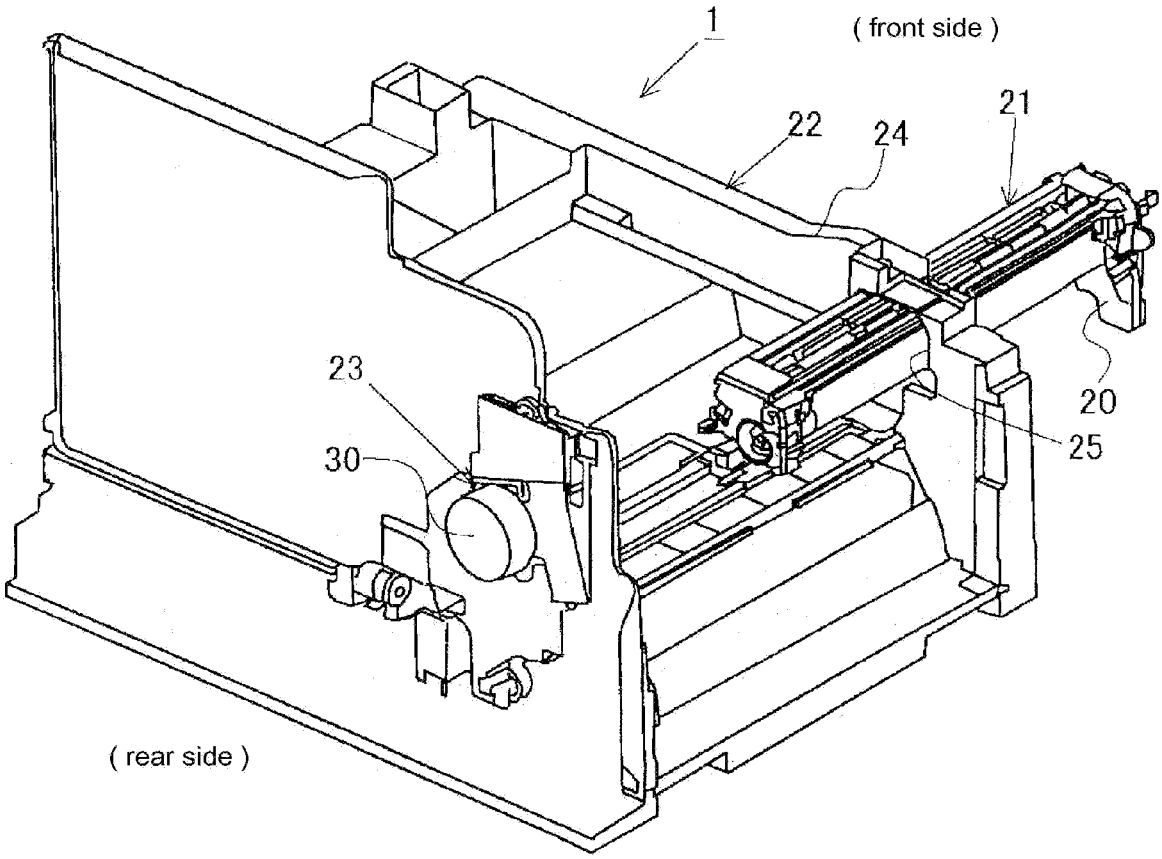
FIG. 4 is a rear perspective view of the installation of the photoconductor unit into the main body of the image forming device in a predetermined position.
Figure 5:
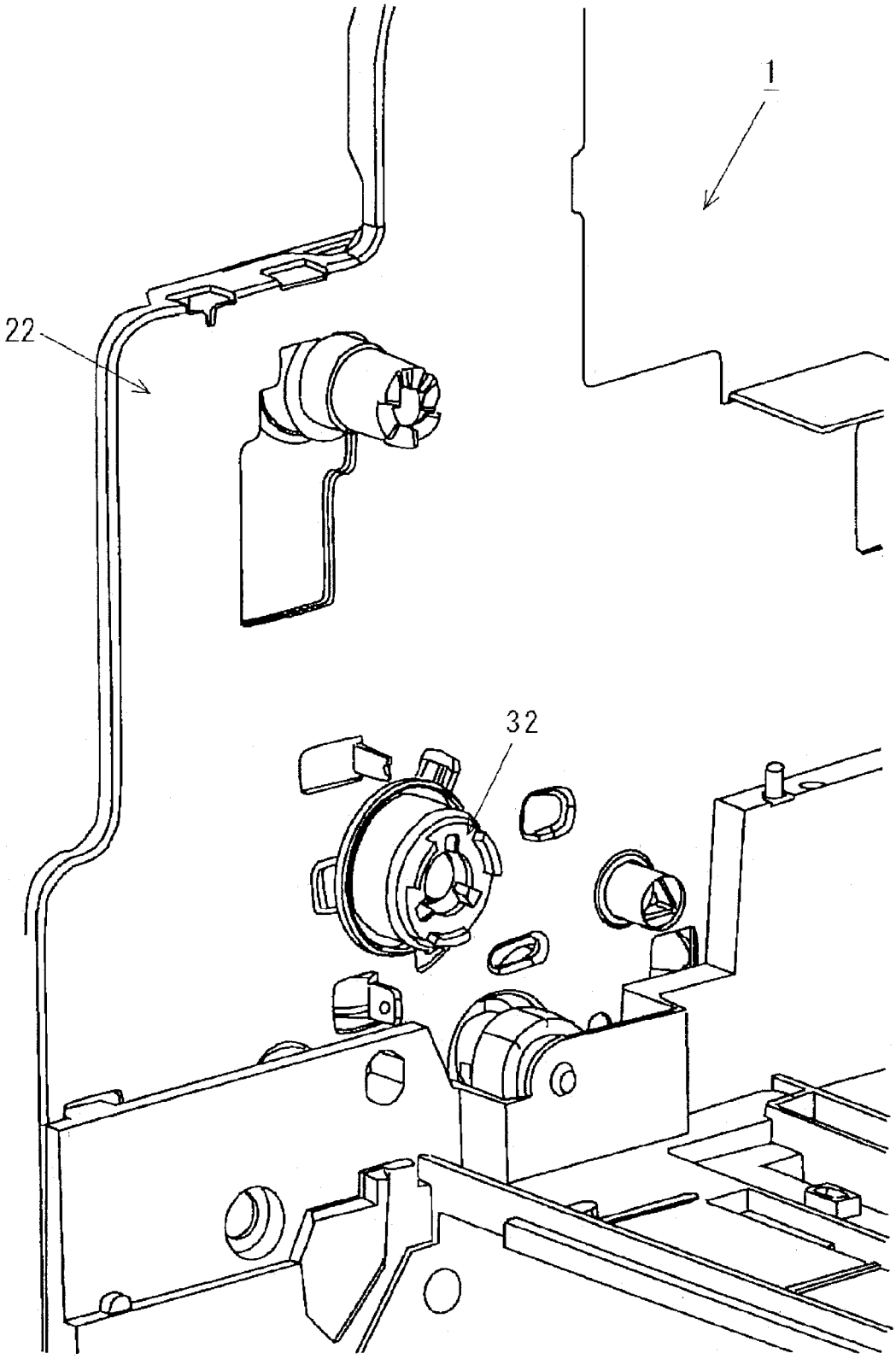
FIG. 5 is an enlarged partial perspective view of FIG. 3.

FIG. 3 and FIG. 4 show the photoconductor unit 21 being installed in a predetermined position in the main body 22 of the image forming device, wherein only the main frame of the main body 22 of the image forming device, the photoconductor unit 21, and the drive unit 23 operably connected to the photoconductor unit 21 are shown in order to illustrate the installation. FIG. 3 is a front perspective view of the main body 22 of the image forming device when viewed from the same view point shown in FIG. 1. FIG. 4 shows a rear perspective view of the main body 22 of the image forming device. And FIG. 5 is an enlarged partial perspective view of FIG. 3.

Figure 6:
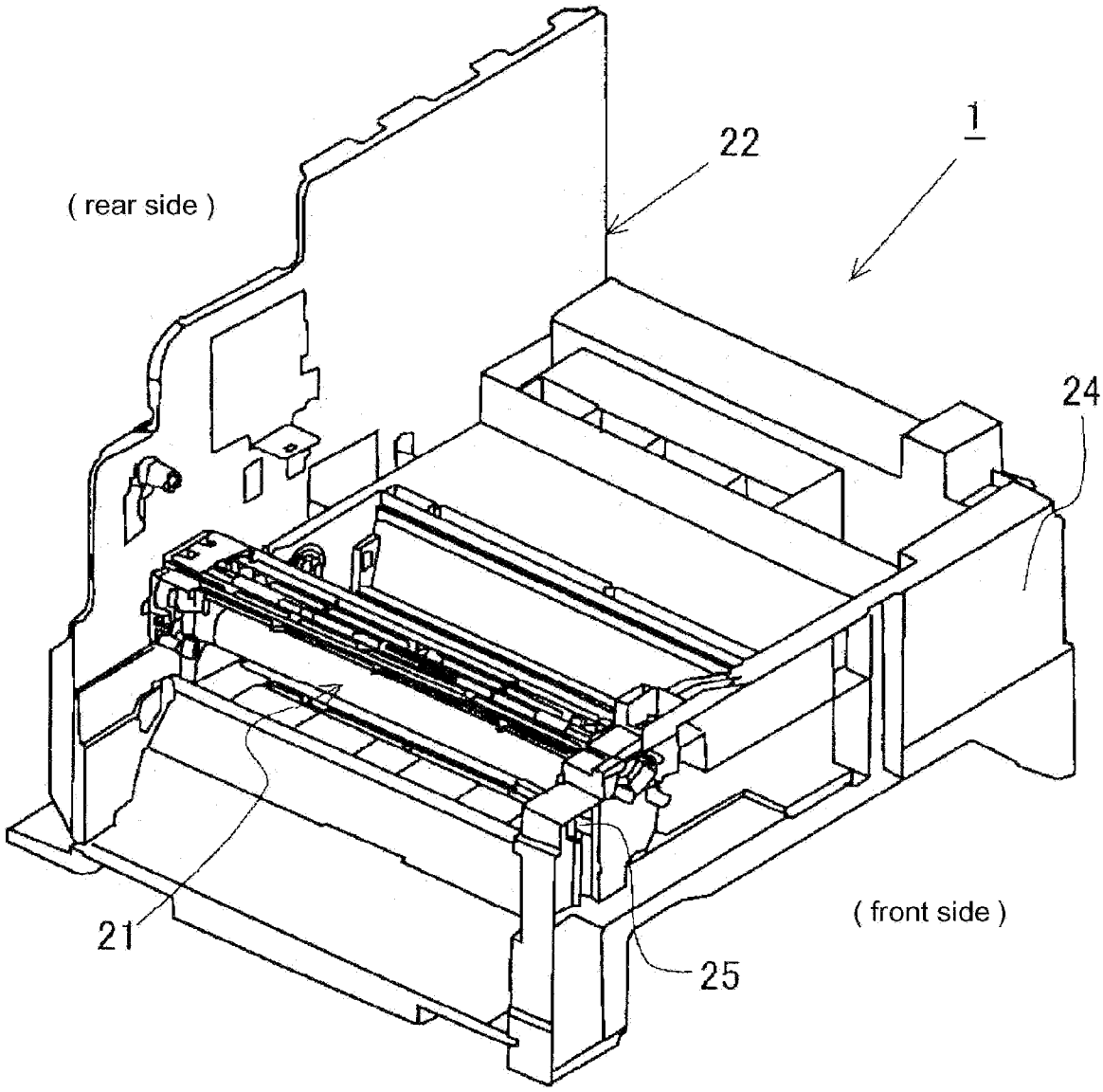
FIG. 6 is a perspective view of the main body of the image forming device after the photoconductor unit has been installed in position.
Figure 7:
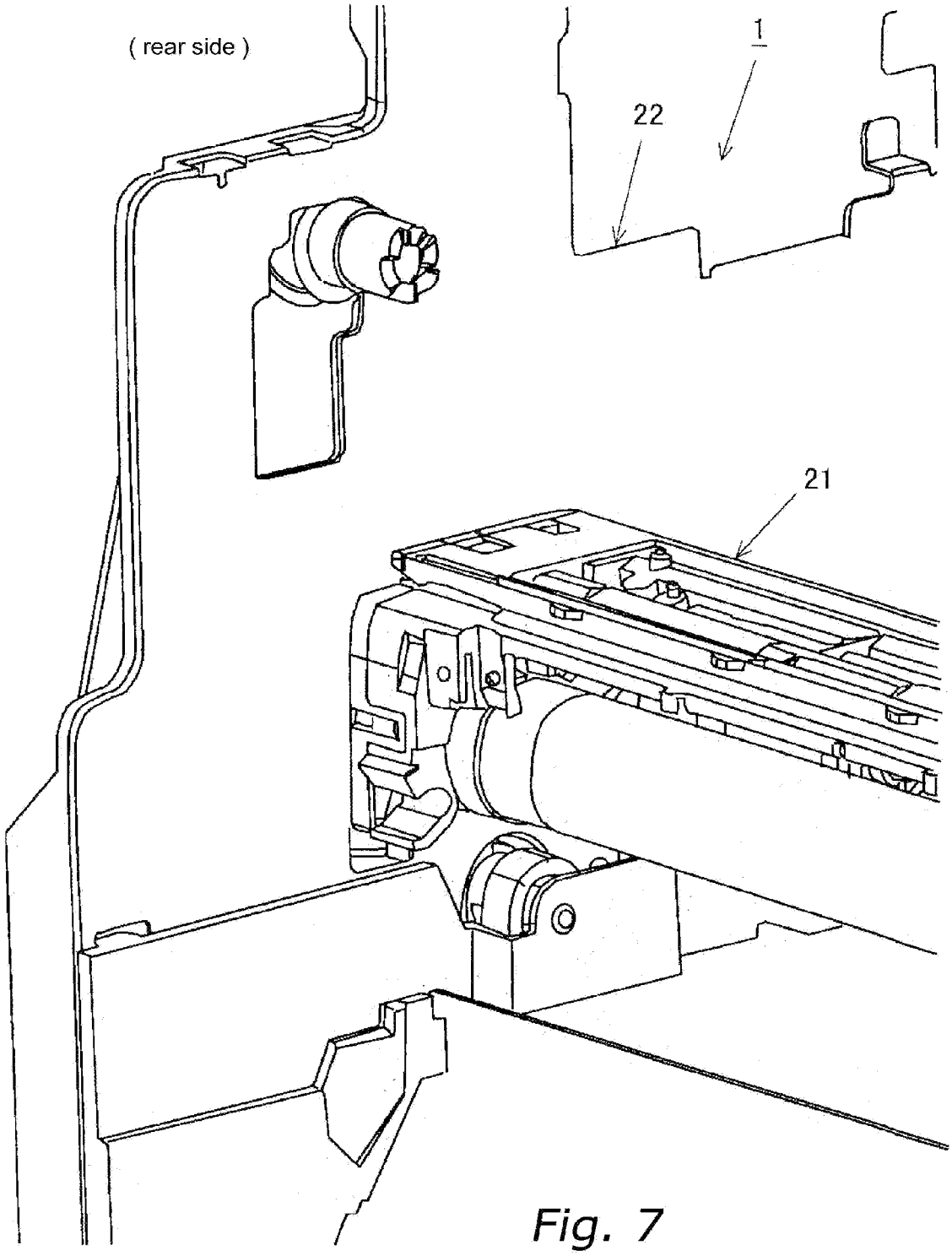
FIG. 7 is an enlarged partial perspective view of FIG. 6.
Figure 8:
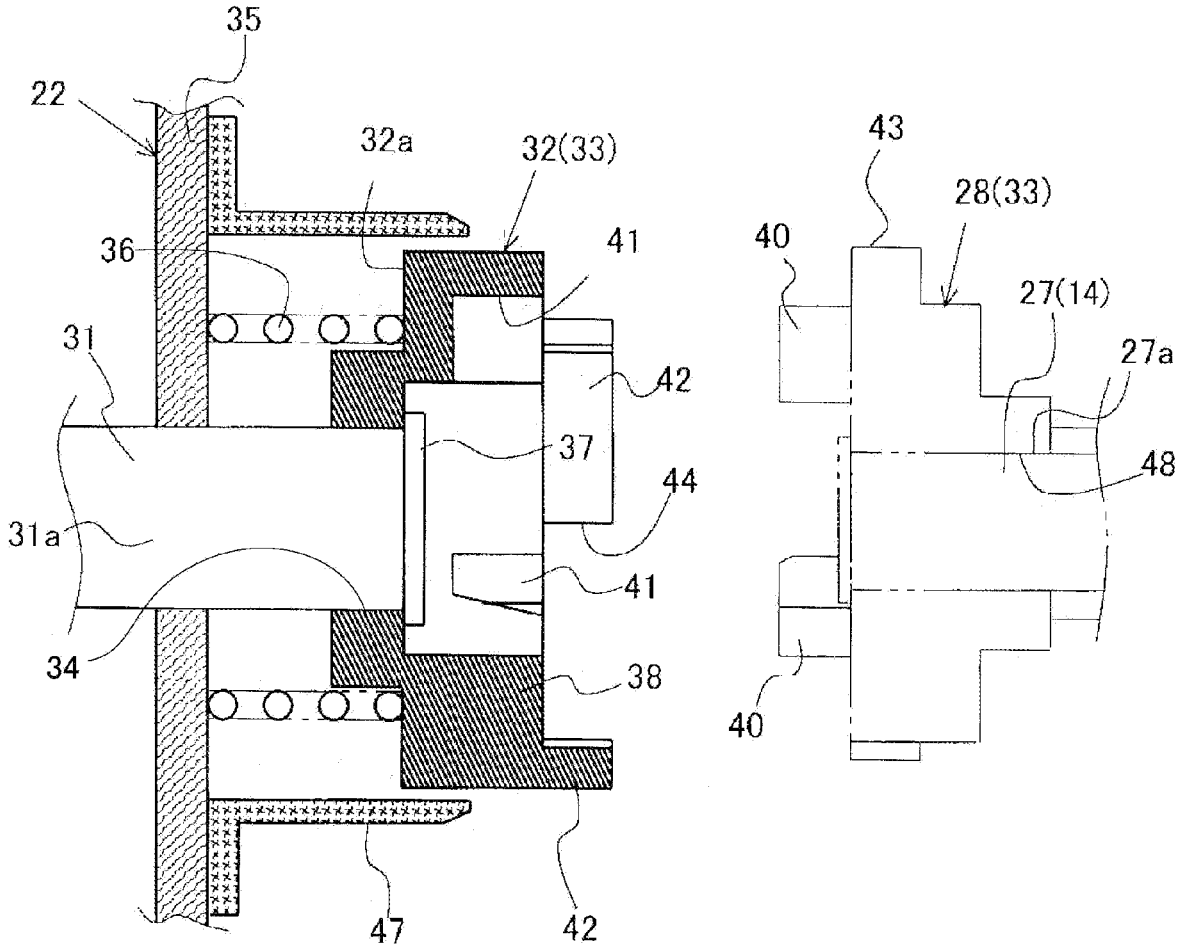
FIG. 8 is a cross sectional view showing the shaft coupling when the coupling is disengaged.
Figure 9:
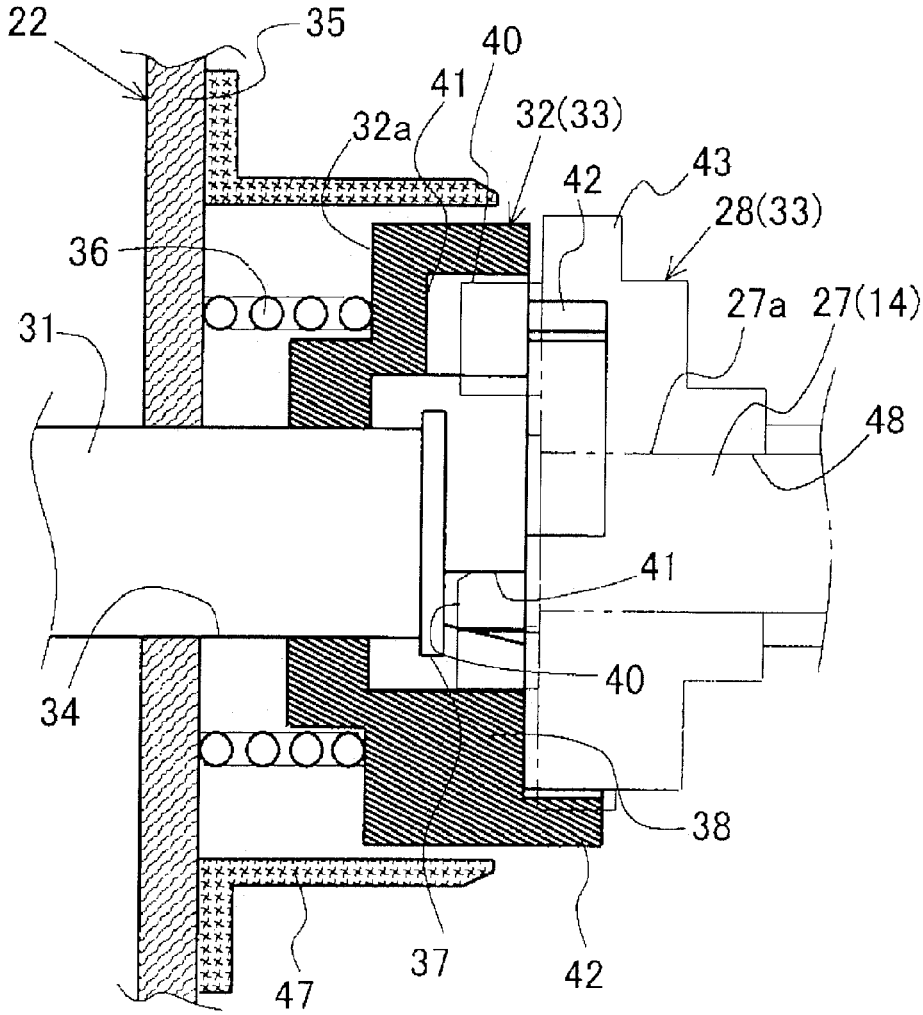
FIG. 9 is a cross sectional view showing the shaft coupling when the coupling is engaged.
Figure 10:
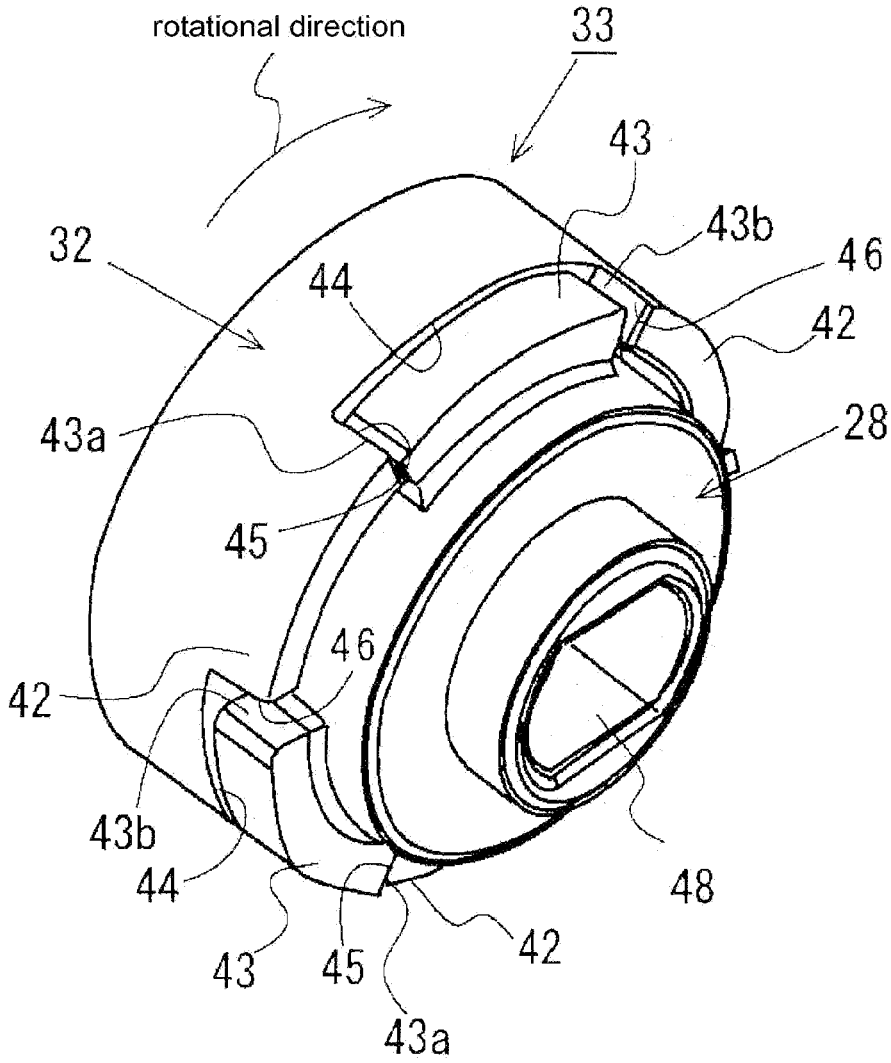
FIG. 10 is an external perspective view of the shaft coupling as seen from the rear surface of the driven coupling.
Figure 11:
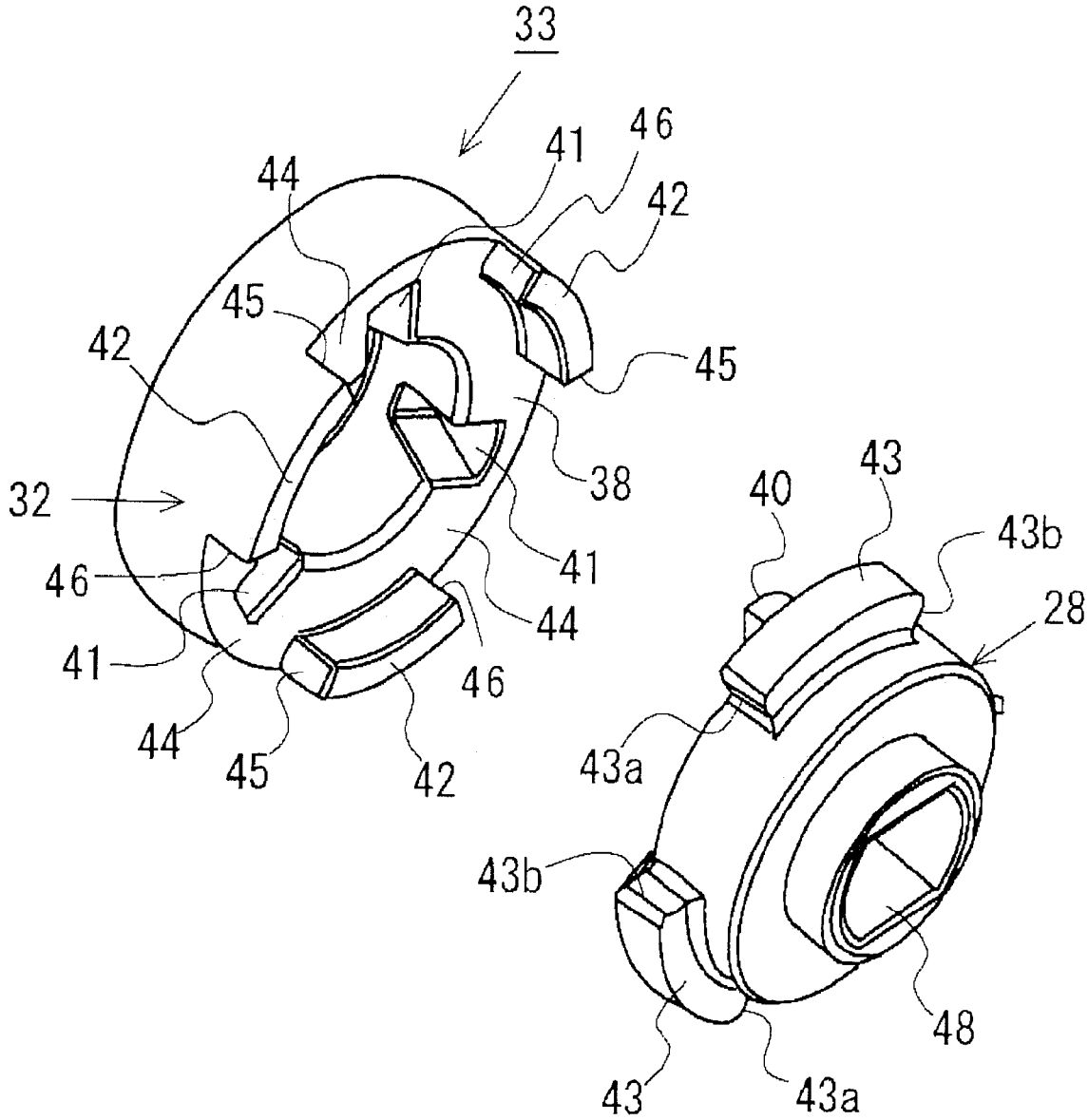
FIG. 11 is an exploded perspective view of the shaft coupling as seen from the rear surface of the driven coupling.
Figure 12:
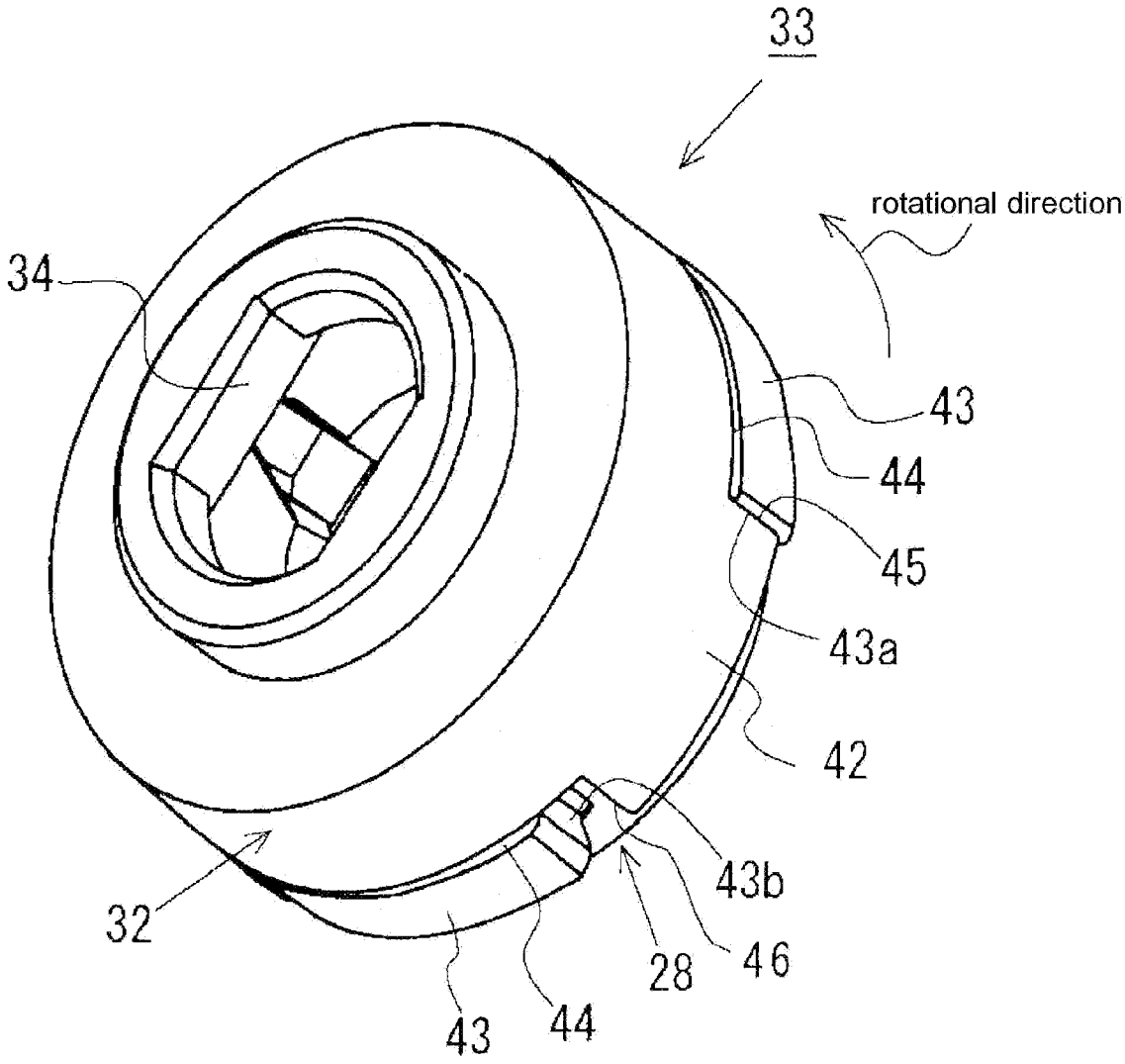
FIG. 12 is an external perspective view of the shaft coupling as seen from the rear surface of the drive coupling.
Figure 13:
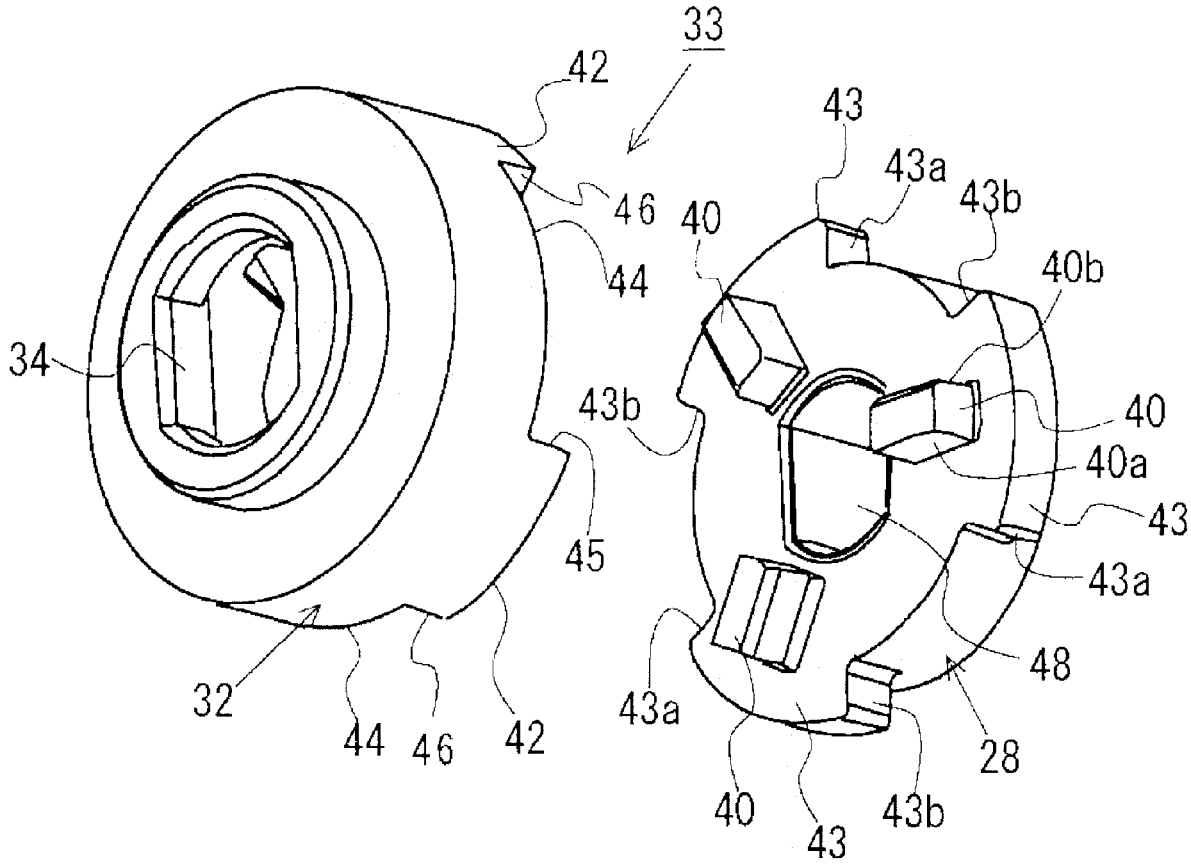
FIG. 13 is an exploded perspective view of the shaft coupling as seen from the rear surface of the drive coupling.

As shown in these figures, the front frame 24 of the main body 22 of the image forming device has an opening 25 through which the photoconductor unit 21 can be installed or removed. After the front cover 26 shown in FIG. 1 is opened, the photoconductor unit 21 can be inserted in the direction shown in FIG. 3 into the predetermined set position in the main body 22 of the image forming device through the opening 25, allowing the drive coupling 28 to be engaged with the drive coupling 32. The driven coupling 28 is attached to the end of the driven shaft 27 (revolving shaft) of the photoconductive drum 14, and the drive coupling 32 is attached to the end of the drive shaft 31 extending from a motor 30 (shown in FIG. 8 and FIG. 9). Accordingly, the photoconductor unit 21 is attached in a predetermined set position in the main body 22 of the image forming device (refer to FIG. 6 and FIG. 7), so that the drive of the motor 30 is precisely transmitted to the driven shaft 27 of the photoconductive drum 14 via a shaft coupling 33 consisting of the drive coupling 32 and the driven coupling 28. Note that near the opening 25 on the front frame 24 is disposed a holding means (not shown in the drawings) for maintaining the photoconductor unit 21 at the predetermined position in the main body 22 of the image forming device, and it is necessary to release the engagement between the holding means and the photoconductor unit 21 in order to pull out the photoconductor unit 21 from the main body 22 of the image forming device.

Shaft Coupling

As shown in FIG. 8 to FIG. 13, the shaft coupling 33 coaxially couples the drive shaft 31 rotationally driven by the motor and the driven shaft 27 of the photoconductive drum, and comprises the drive coupling 32 attached to the drive shaft 31 and the driven coupling 28 attached to the driven shaft 27 integral with the photoconductive drum 14 for rotation. The driven coupling 28 and the drive coupling 32 are molded from a synthetic resin or a sintered alloy.

The drive coupling 32 is formed with a hole 34 having two parallel flat faces at its rotational center. The hole 34 is slidingly fitted over a portion 31 a having two parallel flat faces formed at the tip of the drive shaft 31. Accordingly, the drive coupling 32 rotates with the drive shaft 31 integrally. Between a rear surface 32*a* of the drive coupling 32 and a back frame 35 is located a spring 36, whose urging force presses the drive coupling 32 against a retaining protrusion 37 on the tip of the drive shaft 31. The drive coupling 32 is formed with a radially outer end cylindrical portion 38 protruding along the axial direction of the drive shaft 31 on a side surface opposing to the driven coupling 28. Radially inward of the radially outer end cylindrical portion 38 is formed three inner circumference recesses 41 (first concave portions) equidistantly in the circumferential direction, and into which inner circumference projections 40 (first convex portions) of the driven coupling 28 are inserted. Moreover, radially outward of the radially outer end cylindrical portion 38 is formed three circumferential projections 42 extending toward the driven coupling 28, the circumferential projections 42 being located equidistantly in the circumferential direction between the inner circumference recesses 41. Between each of the circumferential projections 42 are formed outer circumference recesses 44 (second concave portions) engaged with outer circumference projections 43 (second convex portions) of the driven coupling 28. The outer circumference recesses 44 encompasses the inner circumference recesses such that rotational trailing-side circumferential end faces 45 are formed so as to be located along lines radiating from the rotational center of the drive coupling 32, and the rotational leading-side circumferential end face 46 makes an open angle of 70° with the rotational trailing-side circumferential end face 45 (refer to FIG. 14 and FIG. 15). Note that radially outward of the drive coupling 32 is located a substantially cylindrical protection cylinder 47 attached to the back frame 35 with a clearance that prevents interfere with the drive coupling 32. In addition, the inner circumference recess 41 and the outer circumference recesses 44 have chamfered peripheral edges on surfaces opposing to the driven coupling 28, so that they can be smoothly engaged with the inner circumference projections 40 and the outer circumference projections 43 of the driven coupling 28, respectively.

The driven coupling 28 is formed with a hole 48 having two parallel flat faces at its rotational center fitted over a portion 27 having two parallel flat faces of the driven shaft 27 which rotates integrally with the photoconductive drum 14 so as to rotate with the photoconductive drum 14 integrally. On a side surface of the driven coupling 28 opposing to the drive coupling 32 are formed the three inner circumference projections 40 to be fitted into the inner circumference recesses 41 of the drive coupling 32. The three inner circumference projections 40 are substantially rectangular parallelepiped projections extending in the radial direction at intervals of 120° in the circumferential direction. On the outer circumferential surface of the driven coupling 28 and radially outward of the inner circumference projections 40 are formed the three outer circumference projections 43 at intervals of 120° in the circumferential direction. The outer circumference projection 43 has an opening angle of 60° in the circumferential direction, and has circumferential end faces (side surfaces) 43*a* and 43*b* located along lines radiating from the rotational center of the driven coupling 28. The outer circumference projection 43 is adapted to be in surface-to-surface contact with the circumferential end faces 45 (rotational trailing-side side surface) of the outer circumference recess 44 of the drive coupling 32, but to be engaged with the circumferential end face 46 (rotational leading-side side surface) of the drive coupling 32 with a clearance of 10° in the circumferential direction. Note that the inner circumference projections 40 and the outer circumference projections 43 have chamfered peripheral edges of surfaces opposing to the drive coupling 32 so that they can be smoothly engaged with the inner circumference recesses 41 and the outer circumference recesses 44 of the drive coupling 32, respectively.

Figure 14:
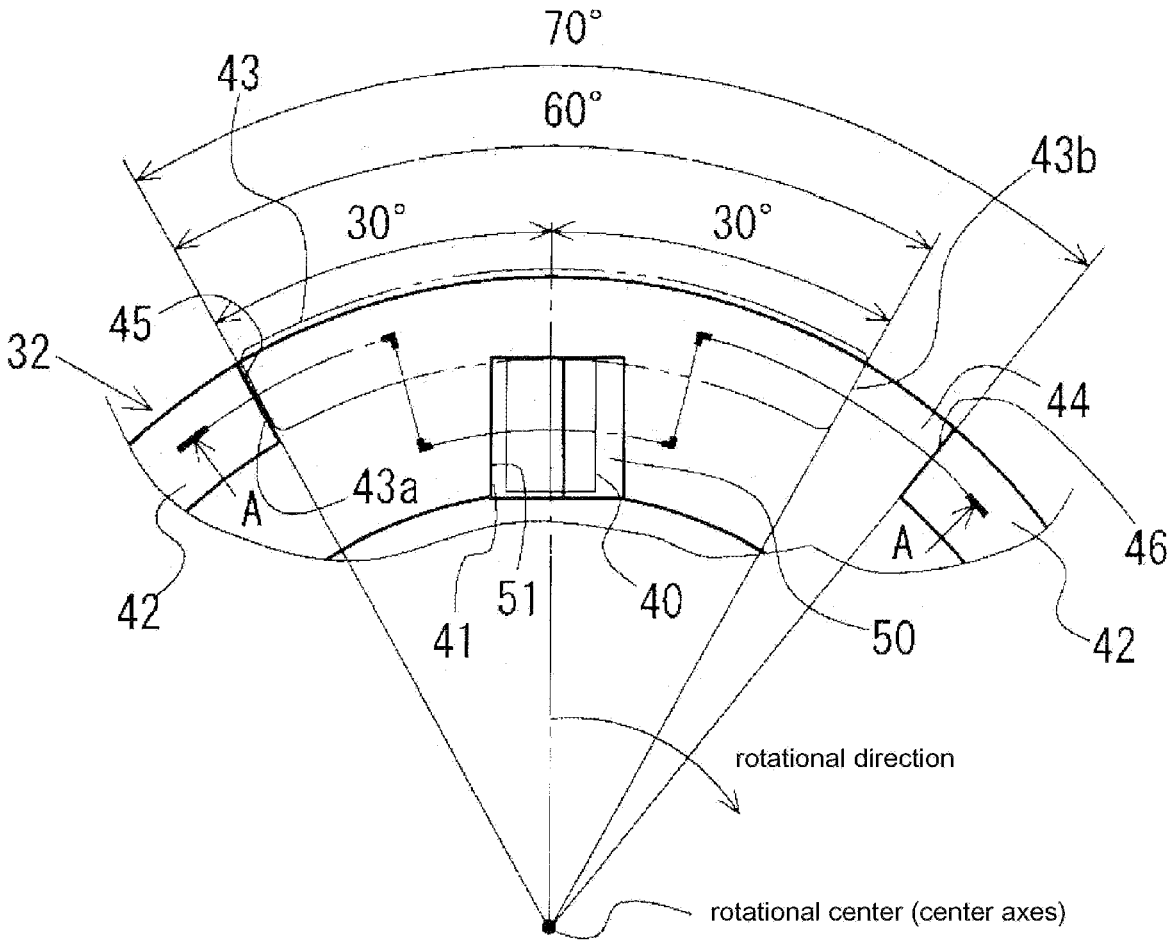
FIG. 14 is a partial, front view showing the engagement state of the drive coupling and the driven coupling.
Figure 15:
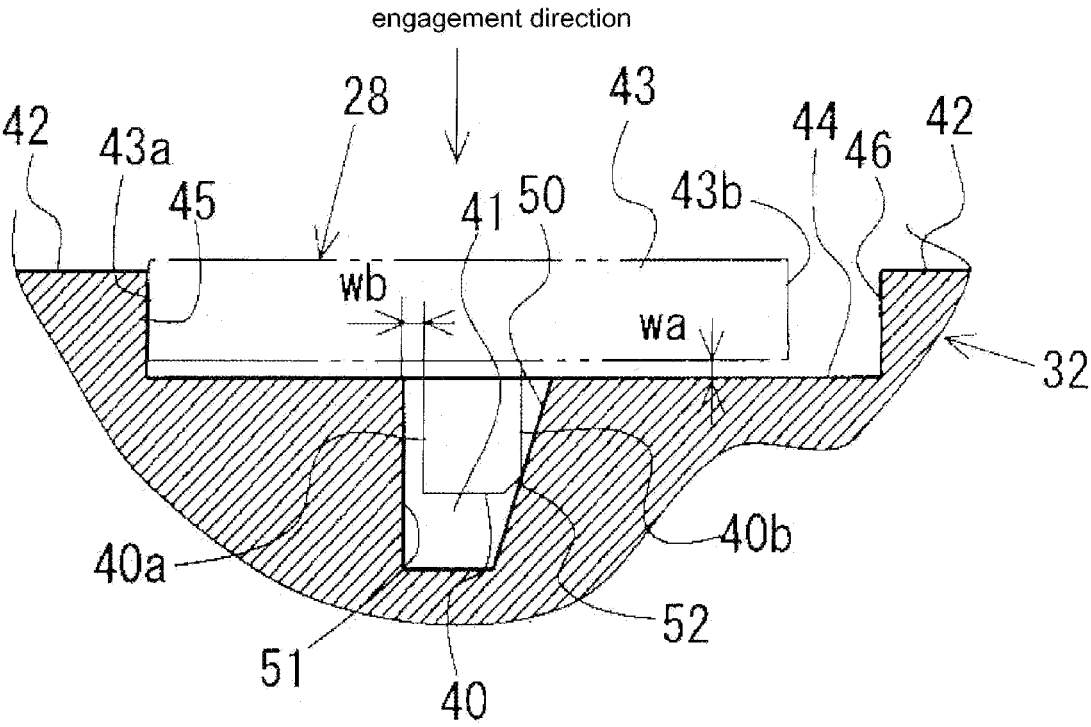
FIG. 15 is a cross sectional view taken along line A-A in FIG. 14.

FIG. 14 and FIG. 15 show an engagement between the inner circumference recess 41 of the drive coupling 32 and the inner circumference projection 40 of the driven coupling 28 and an engagement between the outer circumference recess 44 of the drive coupling 32 and an outer circumference projection 43 of the driven coupling 28. FIG. 14 is a partial front view showing an engagement state between the drive coupling 32 and the driven coupling 28. FIG. 15 is a cross section taken along line A-A in FIG. 14.

As shown in these figures, a rotational leading-side side surface 50 (cam face, inclined surface) of the inner circumference recess 41 of the drive coupling 32 is inclined such that it approaches a rotational trailing-side side surface 51 with approach in the engagement direction of the inner circumference projection 40 of the driven coupling 28 (with approach downward in FIG. 15). A tip of the inner circumference projection 40 of the driven coupling 28, which is in contact with the inclined surface 50, has a chamfered peripheral edge so as to form a chamfered portion 52 of the inner circumference projection 40. The chamfered portion 52 is in line-to-line contact with the inclined surface 50 of the inner circumference recess 41. Rotational trailing-side circumferential end face 43*a* of the outer circumference projection 43 of the driven coupling 28 is in surface-to-surface contact with rotational trailing-side circumferential end face 45 of the outer circumference recess 44 of the drive coupling 32. A clearance "wa" is formed between axially facing surfaces of the drive coupling 32 and the driven coupling 28, and another clearance "wb" is formed between the rotational trailing-side side surface 40*a* of the inner circumference projection 40 and the rotational trailing-side side surface 51 of the inner circumference recess 41. The drive coupling 32 is urged by the spring 36 toward the driven coupling 28 (refer to FIG. 8 and FIG. 9).

All the surfaces including 40*a* and 40*b* of the inner circumference projection 40, the side surface 51 of the inner circumference recess 41, the end faces 43*a* and 43*b* of the outer circumference projection 43, and the end faces 45 and 46 of the outer circumference recess 44 are parallel with the sliding direction of the driven shaft 27 so that drive coupling 32 and the driven coupling 28 can be smoothly engaged and disengaged.

Consequently, by means of a component force in the rotational direction of the urging force generated at a contact portion between the inner circumference projection 40 and the inclined surface 50 of the inner circumference recess 41, the rotational trailing-side circumferential end face 43*a* of the outer circumference projection 43 is pressed against the rotational trailing-side circumferential end face 45 of the outer circumference recess 44. More specifically, the chamfered portion 52 of the inner circumference projection 40 of the driven coupling 28 gets into contact with the inclined surface 50 of the inner circumference recess 41 of the drive coupling 32 without a clearance, and the rotational trailing-side circumferential end face 43*a* of the outer circumference projection 43 of the driven coupling 28 gets into contact with the rotational trailing-side circumferential end face 45 of the outer circumference recess 44 of the drive coupling 32 without a clearance. As a result, the drive coupling 32 and the driven coupling 28 rotate integrally without any rattling in the rotational direction, thus effectively preventing the coupling skip in the shaft coupling 33 when the drive is transmitted with a large torque.

Figure 17:
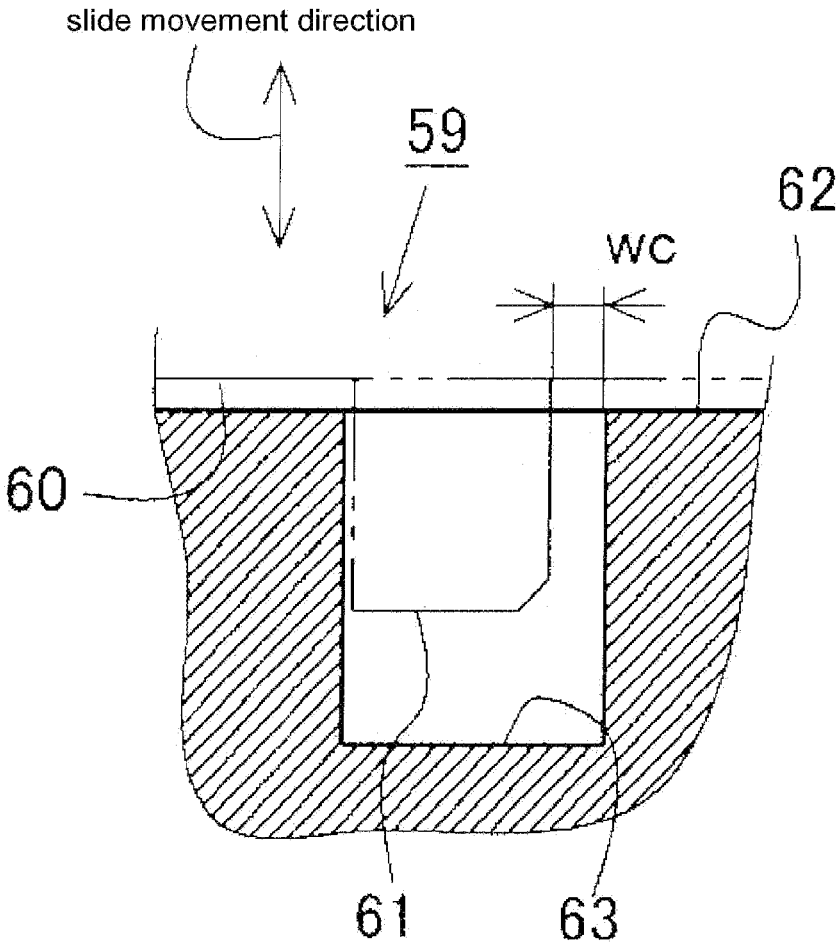
FIG. 17 is a partial, cross sectional view of a concave-convex engagement portion that shows a conventional shaft coupling.

In the conventional example shown in FIG. 17, the drive is transmitted only by the engagement between the inner circumference projection 61 of the driven coupling 60 and the inner circumference recess 63 of the drive coupling 62. In contrast, in this embodiment, since the drive is transmitted by the contact portion between the outer circumference projections 43 of the driven coupling 28 and the outer circumference recesses 44 of the drive coupling 32, which is located at the radially outer end, so that turning force applied to a power transmission portion (contact surfaces between the outer circumference projections 43 and the outer circumference recesses 44) becomes smaller, thereby more effectively preventing the coupling skip phenomenon.

Furthermore, in the present embodiment, as mentioned above, the tip (the chamfered portion 52) of the rotational leading-side side surface of the inner circumference projection 40 of the driven coupling 28 is in contact with the inclined surface 50 of the inner circumference recess 41 of the drive coupling 32 without a clearance, and the rotational trailing-side circumferential end face 43*a* of the outer circumference projection 43 of the driven coupling 28 and the rotational trailing-side circumferential end face 45 of the outer circumference recess 44 of the drive coupling 32 are in contact with each other without a clearance. Accordingly, the drive coupling 32 and the driven coupling 28 rotate integrally without any rattling in the rotational direction so that it is possible to prevent wear due to a relative sliding between the circumferential end face 43*a* of the outer circumference projection 43 of the driven coupling 28 and the circumferential end face 45 of the outer circumference recess 44 of the drive coupling 32 to improve durability of the shaft coupling 33. As a result, the coupling skip phenomenon is more effectively prevented.

Even if the shaft coupling 33 in the present embodiment is rotated to transmit the drive in the opposite direction to the rotational direction of the present embodiment (positive rotational direction), it is possible to transmit the drive without causing any rattling in the rotational direction between the drive coupling 32 and the driven coupling 28.

Although the inclined surface 50 of the inner circumference recess 41 is an inclined surface consisting of a flat surface inclined over the entire area in the depth direction, the present invention is not limited to this embodiment, and a part of the side surface in the depth direction may be an inclined surface. Furthermore, the inclined surface 50 of the inner circumference recess 41 may be an inclined surface having a curvature.

The inclined surface 50 as an inclined surface portion may be formed on the inner circumference projection 40, not on the inner circumference recess 41.

Operation and Advantages of the Present Embodiment

As mentioned above, according to the present embodiment, even if the torque applied to the photoconductive drum 14 is set larger, the shaft coupling 33 can precisely transmit the drive of the motor 30 to the photoconductive drum 14 without causing a coupling skip phenomenon. As a result, a reduction in image quality (jitter) of the printed image due to rotational variations of the photoconductive drum 14 will be inhibited, so that it is possible to print high quality images for a long period of time.

Figure 18:
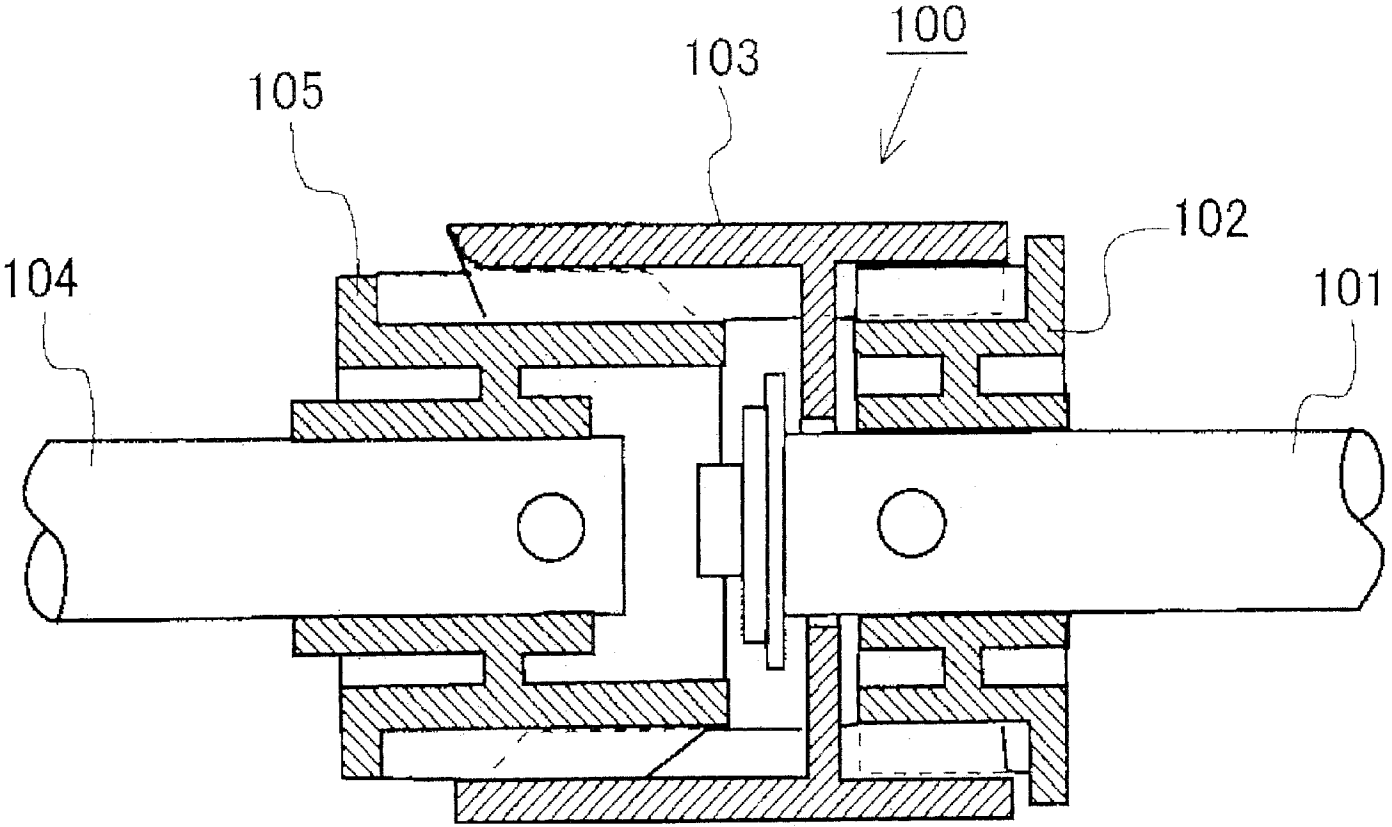
(Prior Art) Fig. 18
FIG. 18 is a cross sectional view of a conventional shaft coupling.

Furthermore, as described above, since drive coupling 32 and the driven coupling 28 are directly meshed with each other, the shaft coupling 33 in the present embodiment can have a shorter axial length compared to the conventional shaft coupling 59 shown in FIG. 18. And since the projections (inner circumference projections 40 and outer circumference projections 43) and the recesses (inner circumference recesses 41 and outer circumference recesses 44) are engaged with each other, slide amount of the driven coupling 28 when the driven coupling 28 and the drive coupling 32 are engaged or disengaged can become smaller than that of the spline engagement of the driven male coupling 105 of the conventional shaft coupling 59 shown in FIG. 18. As a result, the shaft coupling 33 according to the present embodiment can have a more compact structure compared to the conventional shaft coupling 59.

Modification of the Shaft Coupling

Figure 16:
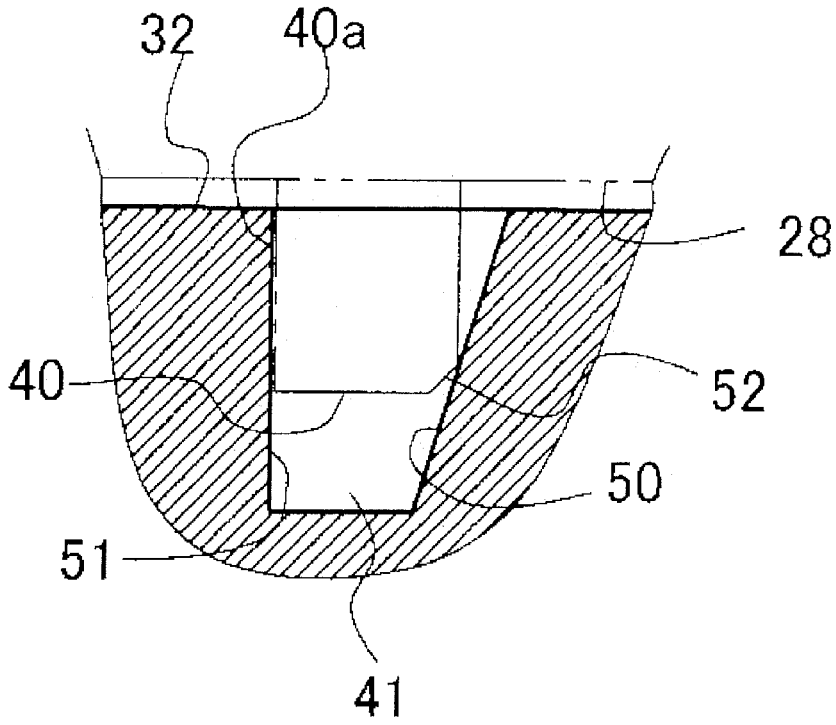
FIG. 16 is a partial, cross sectional view of a concave-convex engagement portion that shows a modification of the shaft coupling according to the present invention.

It should be understood that the above embodiment is just one example of the present invention. As shown in FIG. 16, the tip (chamfered portion 52) of the rotational leading-side side surface of the inner circumference projection 40 of the driven coupling 28 may be in contact with the inclined surfaces 50 of the inner circumference recess 41 of the drive coupling 32, and the rotational trailing-side side surface 40*a* of the inner circumference projection 40 of the driven coupling 28 may be in surface-to-surface contact with rotational trailing-side side surface 51 of the outer circumference recess 44 of the drive coupling 32 in order to rotate the driven coupling 28 and the drive coupling 32 integrally without any rattling in the rotational direction.

In the above-mentioned embodiment, as one example, the driven coupling 28 is provided with the inner circumference projections 40 and the outer circumference projections 43, and the drive coupling 32 is provided with the inner circumference recesses 41 and the outer circumference recesses 44. In contrast, as a modification, the driven coupling 28 may be provided with the inner circumference recesses 41 and the outer circumference recesses 44, and the drive coupling 32 is provided with the inner circumference projections 40 and the outer circumference projections 43.

The inner circumference projections 40 may be formed on one of the driven coupling 28 and the drive coupling 32, and the inner circumference recesses 41 may be formed on the other of the driven coupling 28 and the drive coupling 32. And the outer circumference projections 43 may be formed on one of the driven coupling 28 and the drive coupling 32, and the outer circumference recesses 44 may be formed on the other of the driven coupling 28 and the drive coupling 32.

It should be understood that the numbers of sizes or angles of the shaft coupling 33 shown in the above embodiment are just examples for ease of explanation, and do not limit other possibilities.

The shaft coupling according to the present invention can be applied not only to a connection between the revolving shaft of the photoconductor (a photoconductive drum or a photoconductor belt) and the drive shaft of the motor but also to a connection between the revolving shaft of the developing device or other devices and the drive shaft. Additionally, the shaft coupling according to the present invention is not limited to a copying machine as an image forming device, but can be widely applied to a power transmission unit in a facsimile, a printer and multifunction device having their functions. Furthermore, the shaft coupling according to the present invention can be applied not only to an image forming device but also to a power transmission unit of various machines and devices.

Any terms of degree used herein, such as "substantially", "about" and "approximately", mean a reasonable amount of deviation of the modified term such that the end result is not significantly changed. These terms should be construed as including a deviation of at least ±5% of the modified term if this deviation would not negate the meaning of the word it modifies.

This application claims priority to Japanese Patent Application No. 2005-018003. The entire disclosure of Japanese Patent Application No. 2005-018003 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A shaft coupling for connecting a drive shaft with a driven shaft coaxially arranged with the drive shaft, comprising:

a first coupling attached to one of the drive shaft and the driven shaft;

a second coupling attached to the other of the drive shaft and the driven shaft, the second coupling capable of moving toward and away from the first coupling; and an urging member that urges at least one of the first coupling and the second coupling toward the other;

wherein the first coupling comprises a first coupling portion having a first end face which is formed on a side opposite the second coupling and which extends in the axial direction, and a first concave portion which is formed on a side surface opposite the second coupling;

the second coupling comprises a second coupling portion having a second end face which extends in the axial direction and is capable of surface-to-surface contact with the first end face of the first coupling portion, and a first convex portion which extends toward the first coupling and configured to be inserted into the first concave portion; and the first concave portion of the first coupling portion further includes a cam face with which at least a tip of the first convex portion is capable of coming into contact with in order to convert a pressing force of the first convex portion into a pressing force between the first end face and the second end face.

2. A shaft coupling according to claim 1, wherein the first concave portion is formed with a third end face and a fourth end face in the rotational direction, the third end face extending in the axial direction, and the fourth end face inclined with respect to the third end face and capable of coming into contact with at least the tip of the first convex portion; and the cam face is the fourth end face.

3. A shaft coupling according to claim 2, wherein the first coupling portion is formed with a second concave portion on the surface on which the first concave portion is formed, the second concave portion encompassing the first concave portion and being formed over a range broader than an angular range of the first concave portion;

the second coupling portion includes a second convex portion projecting radially outward from the second coupling and engageable with the second concave portion; and a first clearance is maintained between a surface of the second concave portion facing the second coupling and a surface of the second convex portion facing the first coupling when the first convex portion is in contact with the fourth end face of the first concave portion.

4. A shaft coupling according to claim 3, wherein the first convex portion is formed with a fifth end face that extends in the rotation direction; and a second clearance is maintained between the fifth end face of the first convex portion and the third end face of the first concave portion when the first convex portion is in contact with the fourth end face of the first concave portion.

5. A device for driving a function unit of an image forming device, comprising:

a motor;

a drive shaft connected to the motor;

a driven shaft connected to the function unit and coaxially arranged with the drive shaft; and a shaft coupling that connects the drive shaft with the driven shaft;

the shaft coupling comprising:

a first coupling attached to one of the drive shaft and the driven shaft;

a second coupling attached to the other of the drive shaft and the driven shaft, the second coupling capable of moving toward and away from the first coupling; and an urging member that urges at least one of the first coupling and the second coupling toward the other;

wherein the first coupling includes a first coupling portion having a first end face which is formed on a side opposite the second coupling and which extends in the axial direction, and a first concave portion which is formed on a side surface opposite the second coupling;

the second coupling includes a second coupling portion having a second end face which extends in the axial direction and is capable of surface-to-surface contact with the first end face of the first coupling portion and a first convex portion which extends toward the first coupling and configured to be inserted into the first concave portion; and the first concave portion of the first coupling portion further includes a cam face with which at least a tip of the first convex portion is capable of coming into contact with in order to convert a pressing force of the first convex portion into a pressing force between the first end face and the second end face.

6. A device for driving a function unit of an image forming device according to claim 5, wherein the function unit is a photoconductor unit detachably attached to the image forming unit, the photoconductor unit including a photoconductive drum which is rotated by the motor.

* * * * *